US005372476A

United States Patent [19]

Hemmelgarn et al.

[11] Patent Number: 5,372,476

[45] Date of Patent: Dec. 13, 1994

[54] TURBINE NOZZLE SUPPORT ASSEMBLY

[75] Inventors: Robert J. Hemmelgarn, Mason; Andrew Shepherd, Fairfield, both of Ohio

[73] Assignee: General Electric Company, Cincinnati, Ohio

[21] Appl. No.: 80,670

[22] Filed: Jun. 18, 1993

[51] Int. Cl.[5] ..... F03B 1/04

[52] U.S. Cl. ..... 415/135; 415/139

[58] Field of Search ..... 60/39.31, 39.32; 415/115, 116, 134, 135, 138, 139

[56] References Cited

U.S. PATENT DOCUMENTS

| | | | |
|---|---|---|---|
| 2,914,300 | 11/1959 | Sayre | 253/78 |
| 4,177,004 | 12/1979 | Reidmiller et al. | 415/116 |
| 4,679,400 | 7/1987 | Kelm et al. | 60/722 |
| 4,889,469 | 12/1989 | Wilkinson | 415/116 |
| 4,989,406 | 2/1991 | Vdoviak et al. | 60/261 |
| 5,074,752 | 12/1991 | Murphy et al. | 415/209.4 |
| 5,149,250 | 9/1992 | Plemmons et al. | 415/209.3 |
| 5,176,496 | 1/1993 | Correia et al. | 415/209.2 |
| 5,211,536 | 5/1993 | Ackerman et al. | 415/177 |
| 5,224,822 | 7/1993 | Lenahan et al. | 415/189 |
| 5,249,920 | 10/1993 | Shepherd et al. | 415/134 |

FOREIGN PATENT DOCUMENTS

| | | | |
|---|---|---|---|
| 2061396 | 5/1981 | United Kingdom | 415/135 |

OTHER PUBLICATIONS

S. M. Toborg et al., U.S. patent appln., S/N 08/059,863, filed May 10, 1993, FWC of S/N 07/734,008, filed Jul. 22, 1991.

A. Shepherd, U.S. patent appln., S/N 07/911,235, filed Sep. 9, 1992.

CFM International, CFM56-5C Training Manual, Aug. 1992, page 7 and enlargement.

*Primary Examiner*—Richard A. Bertsch

*Assistant Examiner*—William J. Wicker

*Attorney, Agent, or Firm*—Jerome C. Squillaro; Nathan D. Herkamp

[57] ABSTRACT

A turbine nozzle support assembly includes nozzle segments each having an inner band with an integral retention flange extending radially inwardly therefrom. A plurality of retention tabs extend radially inwardly and are spaced axially aft of the retention flange to define a capture slot therebetween. A nozzle support includes a radially outwardly extending upper flange having a plurality of support pins extending axially, forwardly therefrom and disposed in complementary retention apertures in the retention flanges of the nozzle segments. A retention key is disposed in the capture slot axially between the upper flange and the retention tabs for axially retaining the nozzle segments on the nozzle support.

7 Claims, 4 Drawing Sheets

TURBINE NOZZLE SUPPORT ASSEMBLY

The present invention relates generally to gas turbine engines, and, more specifically, to a turbine nozzle support assembly therein.

BACKGROUND OF THE INVENTION

In a typical gas turbine engine, a stationary turbine nozzle is disposed at the outlet of a combustor for channeling combustion gases therefrom into a high pressure turbine disposed downstream therefrom. Accordingly, the turbine nozzle is subject to the hot combustion gases and therefore includes suitable cooling arrangements using a portion of compressed air bled from the conventional compressor feeding the combustor. In this environment, the turbine nozzle is subject to differential thermal expansion with adjoining components both radially and axially. This can lead to thermal distortion of the turbine nozzle which must be suitably accommodated for reducing undesirable thermally induced stresses therein and for reducing undesirable leakage of the cooling air which would decrease overall efficiency of the engine.

Accordingly, turbine nozzles are typically segmented around the circumference thereof with each nozzle segment having two or more stationary nozzle vanes therein. Suitable seals are provided between the adjacent nozzle segments, with each of the segments typically being supported by a stationary nozzle support for allowing limited movement or floating thereof to accommodate the differential thermal expansion and contraction between adjacent components. When the engine is operated at suitable power settings, the combustion gases exert an axially aft force against the turbine nozzle segments which rigidly holds the nozzle segments against the nozzle support at the radially inner end of the nozzle as well as holds the radially outer end of the nozzle against a conventional shroud hanger disposed downstream therefrom. However, during assembly and at low power settings of the engine, at idle for example, there is little or no gas load to positively locate the nozzle segments against the nozzle support. Accordingly, suitable means must be provided to hold the nozzle segments in place during assembly and to minimize vibration and wear at low power conditions when the combustion gases do not develop sufficient axial force to firmly hold the nozzle segments in position.

In one conventional configuration, the inner band of a nozzle segment is directly bolted to the nozzle support. This arrangement, however, creates bending stresses in the nozzle and support due to differential thermal expansion and contraction, as well as provides a large area of contact between the nozzle and its support through which heat is conducted from the nozzle vanes into the support increasing the temperature thereof and reducing its useful life. Furthermore, holes required for receiving the bolts inherently create stress concentrations and provide potential leakage paths which must be suitably accommodated in a more complex design. And, the nuts and bolts required to assemble this configuration add undesirable weight to the engine and increase assembly and disassembly time. Boltless support configurations are also conventionally known which use retention pins in tongue-and-groove type configurations between the nozzle inner band and the nozzle support for providing a floating assembly thereof for accommodating differential thermal expansion and contraction. However, these configurations require various seals and are relatively complex.

SUMMARY OF THE INVENTION

A turbine nozzle support assembly includes nozzle segments each having an inner band with an integral retention flange extending radially inwardly therefrom. A plurality of retention tabs extend radially inwardly and are spaced axially aft of the retention flange to define a capture slot therebetween. A nozzle support includes a radially outwardly extending upper flange having a plurality of support pins extending axially forwardly therefrom and disposed in complementary retention apertures in the retention flanges of the nozzle segments. A retention key is disposed in the capture slot axially between the upper flange and the retention tabs for axially retaining the nozzle segments on the nozzle support.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
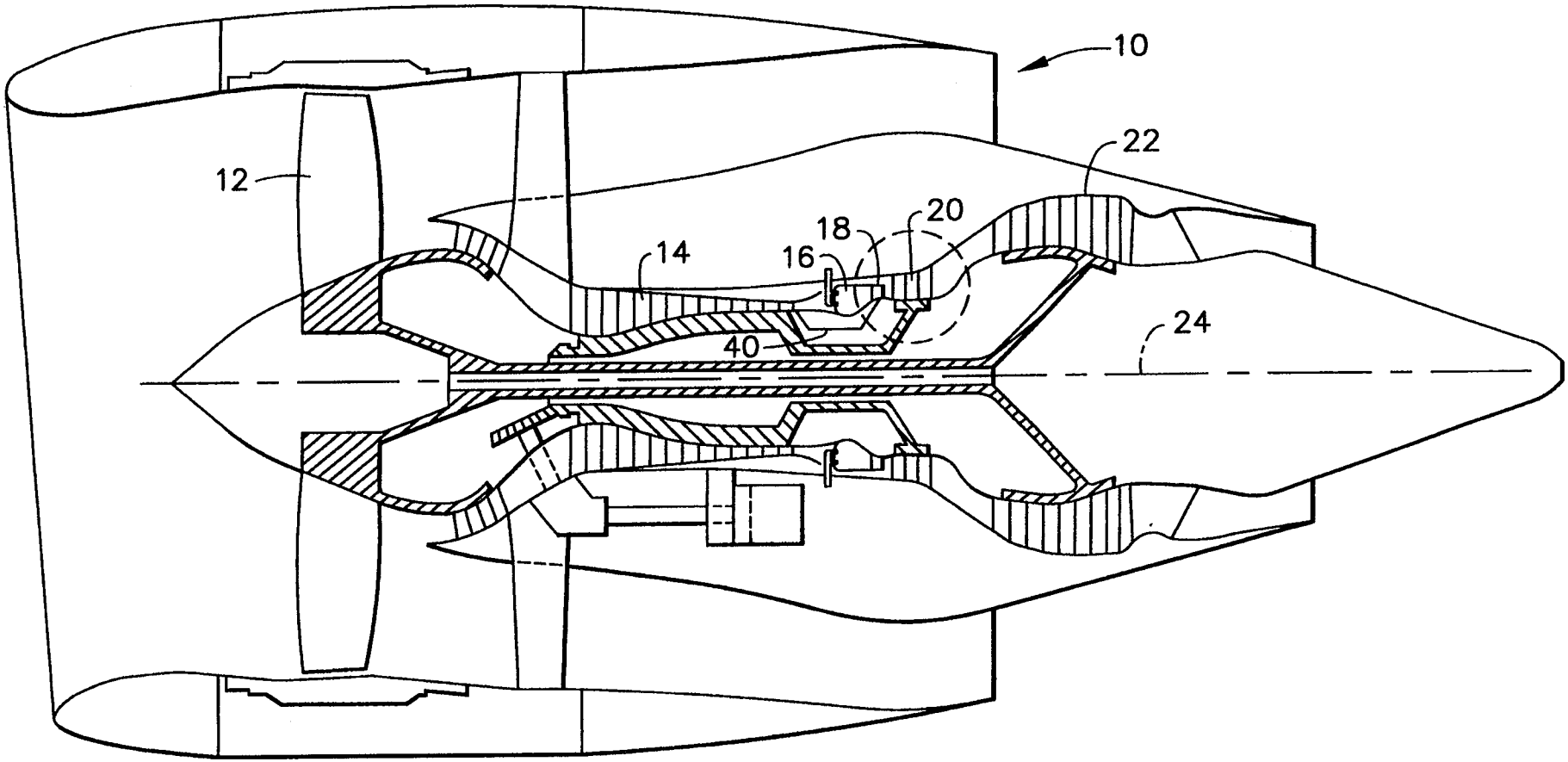
FIG. 1 is a schematic, longitudinal sectional view of an exemplary turbofan gas turbine engine having a turbine nozzle disposed downstream of a combustor therein in accordance with one embodiment of the present invention.

Illustrated schematically in FIG. 1 is an exemplary turbofan gas turbine engine 10 having in serial flow communication a conventional fan 12, high pressure compressor (HPC) 14, and combustor 16. The combustor 16 conventionally generates combustion gases which are discharged therefrom through a high pressure turbine nozzle 18 supported in accordance with one embodiment of the present invention from which the combustion gases are channeled to a conventional high pressure turbine (HPT) 20 and in turn to a conventional low pressure turbine (LPT) 22. The HPT 20 drives the HPC 14 through a suitable shaft, and the LPT 22 drives the fan 22 through another suitable shaft, all disposed coaxially about a longitudinal or axial centerline axis 24.

Figure 2:
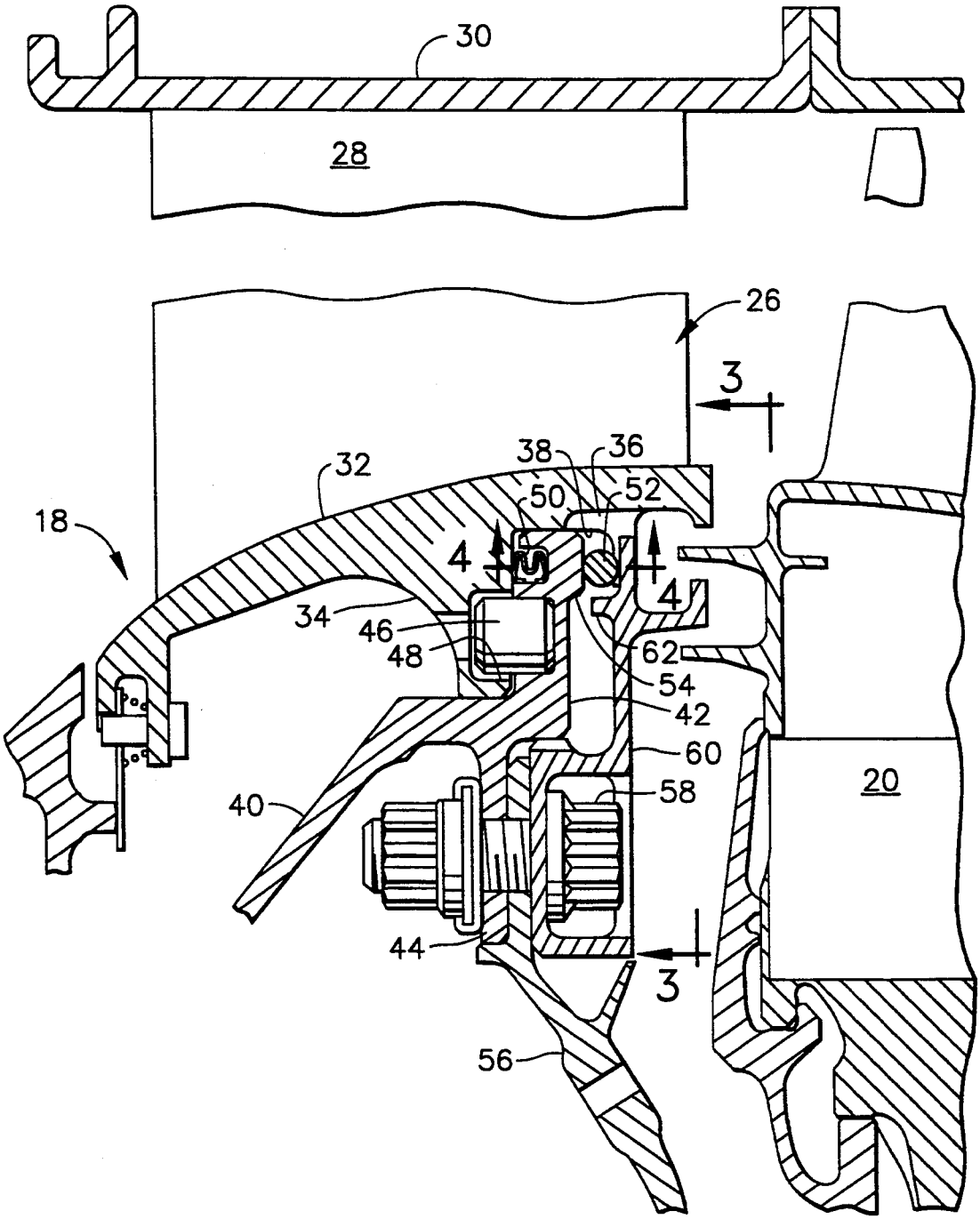
FIG. 2 is an enlarged, partly sectional view of a portion of the turbine nozzle illustrated in FIG. 1 showing a support assembly in accordance with one embodiment of the present invention.
Figure 3:
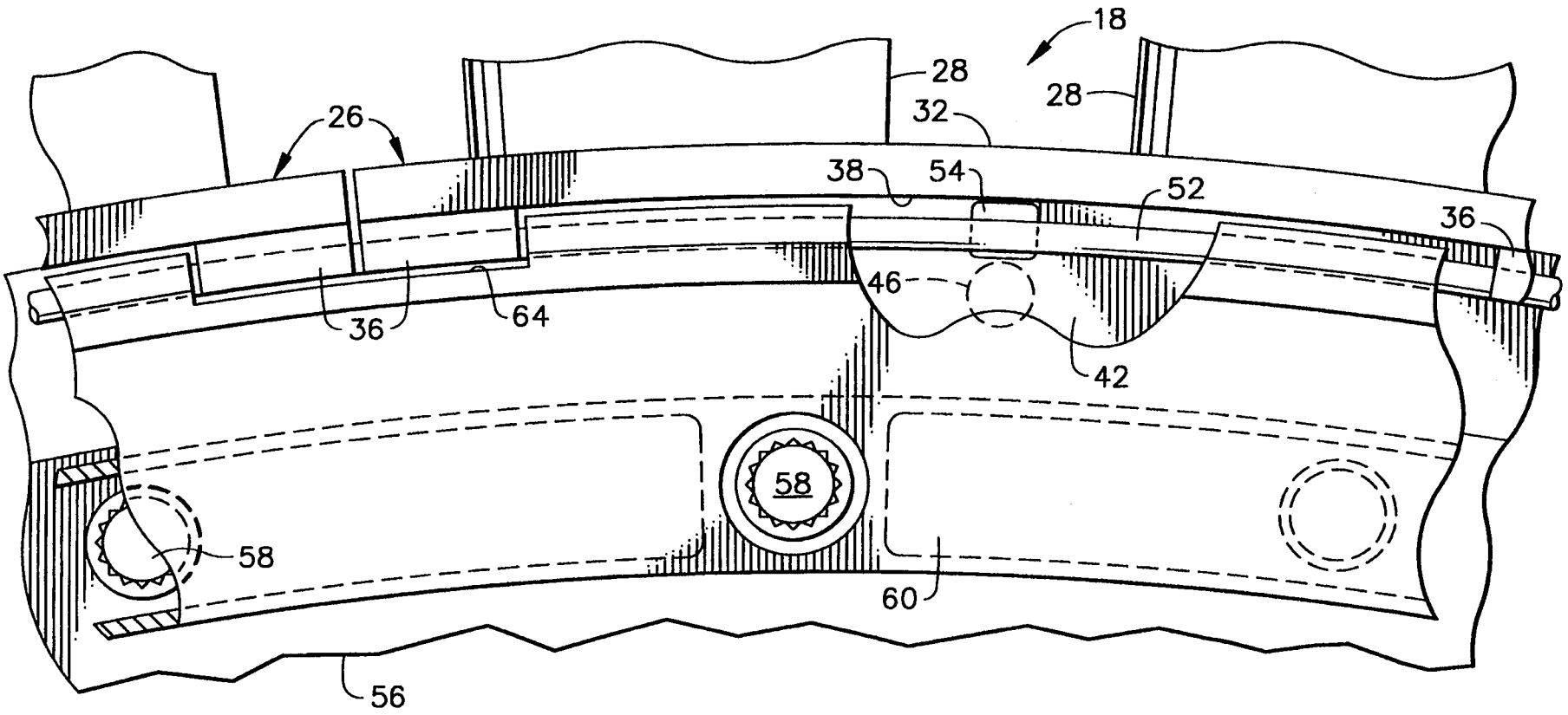
FIG. 3 is a radial, partly cutaway view of a portion of the support assembly illustrated in FIG. 2 and taken along line 3—3.

The radially inner portion of the turbine nozzle 18 and its support assembly is illustrated in more particularity in FIG. 2 in accordance with an exemplary embodiment thereof. The turbine nozzle 18 conventionally includes a plurality of circumferentially adjoining nozzle segments 26, see also FIG. 3, collectively forming a complete 360° assembly. Each segment 26 as shown in FIG. 3 preferably includes at least two circumferentially spaced apart conventional nozzle vanes 28 each having an upstream leading edge and a downstream trailing edge over which the combustion gases flow. As shown in FIG. 2, each segment 26 also includes an arcuate radially outer band 30 and an arcuate radially inner band 32 to which the vanes 28 are integrally attached. The inner band 32 includes an integral retention flange 34 extending radially inwardly therefrom from an axially intermediate portion of the inner band 32 between the leading and trailing edges of the vanes 28. Since the retention flange 34 is preferably integral with the inner band 32 it extends circumferentially for the full arcuate extent of the inner band 32. The inner band 32 also includes a plurality of integral, circumferentially spaced apart retention tabs 36 as shown in FIGS. 2 and 3 which extend radially inwardly therefrom and are spaced axially aft of the retention flange 34 to define a capture slot 38 therebetween.

A stationary, annular nozzle support or shah 40 is suitably provided in the engine 10 and has at an axially and radially distal end thereof an annular radially outwardly extending upper flange 42 and an integral, annular, radially inwardly extending lower flange 44. The upper flange 42 includes a plurality of circumferentially spaced apart support pins 46 facing axially forwardly and disposed in complementary retention apertures 48 in the retention flanges 34. Each of the pins 46 has an axially aft end disposed in an interference fit in a complementary blind hole in the upper flange 42. And, the retention aperture 48 in the retention flanges 34 of the segments 26 are suitably slightly larger than the outer diameter of the pins 46 for allowing limited tilting or floating movement of the nozzle segments 26 in a conventional manner. In the exemplary embodiment illustrated in FIGS. 2 and 3 each of the segments 26 is supported by a respective single one of the pins 46 at an intermediate portion of the retention flange 34, with the pin 46 being effective for radially and circumferentially retaining the nozzle segments 26 on the nozzle support 40.

The capture slot 38 is sized to allow each of the nozzle segments 26 to be installed radially inwardly over the upper flange 42 without obstruction by the retention flange with the support pin 46 or obstruction of the retention tabs 36 with the upper flange 42 until the retention aperture 48 is aligned with its respective support pin 46. The segment 26 is then moved axially aft to place the retention aperture 48 over the support pin 46. In this position, the pin 46 prevents excessive movement of the segment 26 either radially or circumferentially. And, during operation, the combustion gas forces generated in the combustor 16 will urge the vanes 28 and in turn the retention flange 34 in an aft direction against the upper flange 42. A suitable M-shaped seal 50 is preferably disposed between the aft side of the retention flange 34 and the forward side of the upper flange 42 in a suitable recess therein for sealing flow therebetween.

In order to prevent axially forward movement of the retention flange 34 and unintentional disassembly thereof from the upper flange 42, a retention key in the exemplary form of an annular, 360° retention wire or ring 52 is disposed in the capture slot 38 axially between the upper flange 42 and the retention tabs 36 for axially retaining the nozzle segments 26 on the nozzle support 42 by restraining axially forward travel thereof off the pin 46. In this way, the space required in the capture slot 38 for assembling the retention flange 34 over the pin 46 without obstruction therewith or without obstruction of the retention tabs 36 with the upper flange 42 is axially filled by the retention ring 52 upon assembly to prevent unintentional disassembly thereof.

A side view of a portion of the ring 52 is illustrated in more particularity in FIG. 3 and has a suitable diameter relative to the centerline axis 24 of the engine to position the ring 52 radially in line with the tabs 36. The ring 52 is formed of any suitable metal for withstanding its environment, and due to its relatively large diameter it will have inherent flexibility or elasticity. In this way, once the full complement of nozzle segments 26 are installed on their respective mounting pins 46, the ring 52 may be inserted in the capture slot 38 between the upper flange 42 and the tabs 36 starting at any suitable circumferential location with successive circumferential positions of the ring 52 then being elastically moved into position inside their respective tabs 36. For example, the ring 52 may be initially positioned under the tabs 36 located at about the 12 o'clock position followed in turn by insertion thereof clockwise around the ring 52 until the ring 52 is fully inserted into the capture slot 38 and rests along the axially forward surfaces of the respective tabs 36. Of course, disassembly of the ring 52 may be accomplished by reversing this process and pulling a suitable circumferential portion of the ring 52 radially inwardly and axially aft with the successive circumferential portions of the ring 52 being similarly removed.

Figure 4:
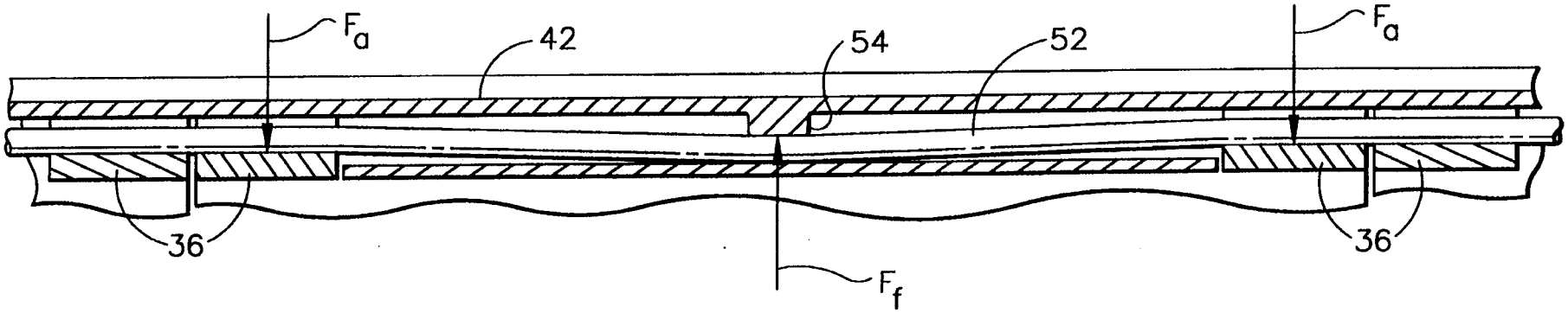
FIG. 4 is a partly sectional view of a portion of the nozzle support assembly illustrated in FIG. 2 and taken circumferentially along line 4—4.

Since the ring 52 has inherent elasticity, it may be also used to preload the retention flange 34 axially aft against the upper flange 42. More specifically, and referring to FIGS. 2–4, the upper flange 42 includes a plurality of circumferentially spaced apart raised pads or bosses 54 facing aft toward the ring 52 and the retention tabs 36, with each of the bosses 54 being disposed circumferentially between adjacent ones of the tabs 36 on each of the nozzle segments 26. As illustrated more clearly in FIGS. 3 and 4, each of the nozzle segments 26 preferably includes a pair of the retention tabs 36 at circumferentially opposite ends thereof, and the respective boss 54 is disposed on the upper flange 42 circumferentially equidistantly between the pair of retention tabs 36. As illustrated in FIG. 4, each boss 54 is preferably sized or has an axially projection, to elastically deflect the retention ring 52 between the circumferentially adjacent retention tabs such as the left and right retention tabs 36 illustrated in FIG. 4 for preloading the retention flange 34 axially aft against the upper flange 42 and for providing friction damping. As the ring 52 is initially inserted between the upper flange 42 and the retention tabs 36, it may also be elastically distorted in the axial direction by the boss 54 bending the ring 52 axially aft relative to the opposing circumferentially adjacent retention tabs 36 which elastically distort the ring 52 in an axially forward direction. In this way, the ring 52 exerts an axially aft force designated $F_a$ in FIG. 4 on each of the retention tabs 36, with an axially forward reaction force $F_f$ being channeled to the stationary upper flange 42 which in turn urges or biases the retention flange 34 axially aft against the forward face of the upper flange 42.

The retention ring 52, therefore, not only prevents unintentional disassembly of the nozzle segments 26 from the upper flange 42, but also provides a preload of the nozzle segments 26 in the axially aft direction, with the spring loaded ring 52 providing friction damping for reducing vibration of the components as well as reducing wear at low power settings. The assembly is also relatively simple in configuration for improving assembly and disassembly of the components for reducing costs.

Although the retention ring 52 is shown as having a uniform circular cross section and being elastically deflected at a plurality of circumferential locations by the circumferentially spaced apart bosses 54, in an alternate embodiment, the aft surface of the upper flange 42 may be flat without the bosses 54 thereon, with the bosses 54 instead being formed integrally with the retention ring 52 itself. In such an embodiment, suitable additional means should be provided to ensure that the bosses 54 on the retention ring 52 are suitably equidistantly positioned between the adjacent tabs 36 to ensure the ability to assemble the parts and the effective operation thereof. Since the axial spacing of the capture slot 38 should be as little as possible to allow insertion of the retention ring 52 therein and the elastic bending thereof, the projected axial spacing between the bosses 54 and the tabs 36 is preferably less than the diameter of the cross section of the ring 52 itself. This is illustrated in FIG. 2 by the aft end of the ring 52 being disposed aft of the forward face of the tab 36 shown therein since this cross section is through one of the bosses 54 which bends the ring 52 in an axial aft direction relative thereto.

Referring again to FIG. 2, a conventional annular forward outer seal 56 in the form of a conical section is conventional bolted to the lower flange 44 by a plurality of bolts 58 and cooperating nuts thereon. The outer seal 56 extends radially inwardly from the lower flange 44 and is used for conventional purposes not relevant to the present invention. A fairing or bolt cover 60 having a radially inner portion in a conventional configuration is bolted to the lower flange 44 by a few of the bolts 58 as is conventionally known, with the fairing 60 covering the heads of the bolts 58 for reducing aerodynamic losses therefrom during operation. However, in accordance with an additional feature of the present invention, the fairing 60 extends radially upwardly to the retention tabs 36 to provide a redundant structure for preventing unintentional removal of the retention ring 52 from the capture slot 38 during operation. The fairing 60 is mounted to the lower flange 44 after the retention ring 52 is assembled into position and therefore ensures its retention therein.

As shown most clearly in FIG. 2, the fairing 60 includes an annular rib 62 extending axially forwardly toward the upper flange 42 and disposed radially below the retention ring 52 with a suitably small radial clearance therewith to radially capture and retain the retention ring 52 in the slot 38. The rib 62 prevents the ring 52 from moving radially inwardly and axially aft of the tabs 36 which ensures its retention against the tabs 36. As shown more clearly in FIG. 3, the fairing 60 preferably also includes a plurality of circumferentially spaced apart perimeter notches 64 sized for receiving respective ones of the tabs 36 therein. The tabs 36 are aligned circumferentially in the notches 64 in a common axial plane for providing aerodynamically reduced drag from the tabs 36. As shown in FIG. 3, a right and left tab 36 of adjacent nozzle segments 36 are preferably disposed in a common, complementary notch 64 in the fairing 60.

Although the retention key described above is in the form of the separate retention ring 52, in an alternate embodiment of the present invention, the radially outer ends of the fairing 60 could instead be reconfigured, such as for example by having the ribs 62 extend radially upwardly into the space between the upper flange 42 and the retention tabs 36 for providing the function of the ring 52 without using a separate ring 52. In this embodiment, the fairing 60 would not be a 360° component, but instead would be formed of arcuate segments to allow each segment to be inserted radially upwardly between the upper flange 42 and the tabs 36 prior to bolting of the fairing segments to the lower flange 44.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the U.S. is the invention as defined and differentiated in the following claims:

What is claimed is:

1. A turbine nozzle support assembly comprising:

a plurality of circumferentially adjoining nozzle segments each nozzle segment including a vane fixedly joined to radially outer and inner arcuate bands, said vane having an axially forward, upstream edge and an axially aft, downstream edge over which combustion gases are flowable, said inner band having an integral retention flange extending radially inwardly from an axially intermediate portion of said inner band, and a plurality of integral, circumferentially spaced apart retention tabs extending radially inwardly and spaced axially aft from said retention flange to define a capture slot therebetween;

an annular nozzle support supporting said plurality of nozzle segments, said nozzle support having at a distal end thereof a radially outwardly extending upper flange disposed axially between said retention flanges and said retention tabs and including a plurality of circumferentially spaced apart support pine facing axially forwardly and disposed in complementary retention apertures in said retention flanges for radially and circumferentially retaining said nozzle segments on said nozzle support;

each of said pins having axially forward and aft, opposite ends, with said pin aft ends being fixedly joined to said upper flange and spaced axially forwardly from said retention tabs;

said capture slot being sized to allow each of said nozzle segments to be installed radially inwardly over said upper flange and said pins without obstruction therefrom, and without obstruction of said retention tabs with said upper flange until said retention aperture is aligned with a respective one of said pins; and a beltless retention key disposed in said capture slot axially between said upper flange and said retention tabs, and having a diameter to position said entire retention key radially in line with said retention tabs, for axially retaining said nozzle segments on said nozzle support to prevent axially forward movement of said retention flange off said pin.

2. An assembly according to claim 1 wherein said retention key is in the form of an annular retention ring.

3. An assembly according to claim 2 wherein said upper flange includes a boss facing aft toward said retention tabs and disposed circumferentially therebetween, said boss being sized to elastically deflect said retention ring between said tabs for preloading said retention flange against said upper flange and for providing friction damping.

4. An assembly according to claim 3 wherein each of said nozzle segments includes a pair of said tabs at circumferentially opposite ends thereof, and said boss is disposed on said upper flange equidistantly between said pair of tabs.

5. An assembly according to claim 4 wherein said nozzle support further includes at said distal end thereof an integral radially inwardly extending lower flange disposed below said upper flange, and further comprising an annular fairing bolted to said lower flange, said fairing having an annular rib extending axially forwardly toward said upper flange and disposed radially below said retention ring to capture said retention ring between said boss and said tabs.

6. An assembly according to claim 5 wherein said fairing further includes a plurality of perimeter notches sized for receiving said tabs.

7. An assembly according to claim 5 further comprising an annular forward outer seal bolted to said lower flange and extending radially inwardly therefrom, and wherein said fairing is in the form of a bolt cover disposed over bolts in said lower flange.

* * * * *